US005393154A

United States Patent [19]

Hubbell

[11] Patent Number: 5,393,154

[45] Date of Patent: Feb. 28, 1995

[54] HOOK AND BINDER ARRANGEMENT

[75] Inventor: John W. Hubbell, Wheaton, Ill.

[73] Assignee: Acco USA, Inc., Wheeling, Ill.

[21] Appl. No.: 966,962

[22] Filed: Oct. 27, 1992

[51] Int. Cl.[6] ..... B42F 13/40

[52] U.S. Cl. ..... 402/4; 402/80 R; 402/80 P

[58] Field of Search ..... 402/4, 80 R, 80 P

[56] References Cited

U.S. PATENT DOCUMENTS

| | | | |
|---|---|---|---|
| 3,801,175 | 4/1974 | Giulie | 402/4 X |
| 3,826,582 | 7/1974 | Podosek | 402/4 |
| 4,395,058 | 7/1983 | Terrell | 402/4 X |
| 4,950,096 | 8/1990 | Gilder | 402/4 |
| 4,979,626 | 12/1990 | Pitts | 402/4 X |

FOREIGN PATENT DOCUMENTS

| | | | |
|---|---|---|---|
| 0283288 | 9/1988 | European Pat. Off. | 402/4 |
| 2306089 | 10/1976 | France | 402/4 |

*Primary Examiner*—Paul A. Bell
*Attorney, Agent, or Firm*—Pennie & Edmonds

[57] ABSTRACT

A pair of detachable hooks for engagement to posts of a binder. The hooks have longitudinal and cross slots for permitting detachable engagement of the hooks on the posts.

4 Claims, 4 Drawing Sheets

HOOK AND BINDER ARRANGEMENT

BACKGROUND OF THE INVENTION

The use of retractable hooks for hanging binders is old including the use of both turnable and extendable hook arrangements (U.S. Pat. No. 4,979,626). Hooks having internal slots for accommodating a binder post and for controlling extension and retraction of the hooks have also been disclosed (U.S. Pat. No. 4,950,096).

SUMMARY OF THE INVENTION

Broadly, the present invention comprises a pair of detachable hook members for engagement and disengagement with the posts of a post binder. The hooks have longitudinal slots for extending and retracting the hooks. Each hook further has a cross slot and a deflectable projection adjacent, to increase the effective size of the cross slot during operation.

It is a feature of the invention that the hooks can be attached to the binder and detached without undoing the post and rail portion of the binder.

DESCRIPTION OF THE PREFERRED EMBODIMENT OF THE INVENTION

Figure 4:
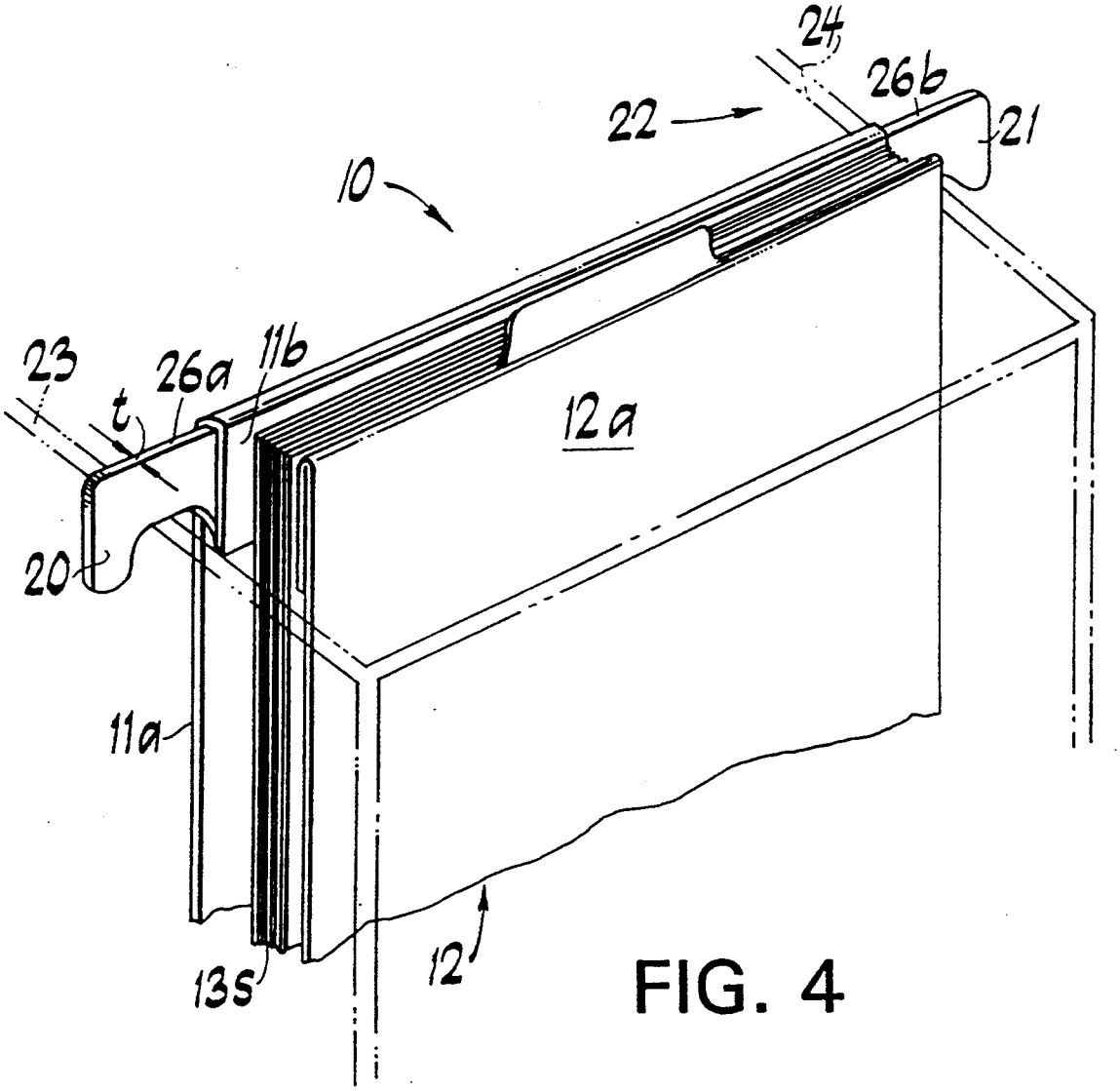
FIG. 4 is a perspective view of the binder (partially exploded) hanging on a rack.

In the Figures, binder 10 is comprised of front cover 11, back cover 12 (FIG. 2) and a number of sheet 13*s*, rail 14, and post 17*a*, post 17*b* (not shown) and post hold-down ring piece 18*a*, and ring piece 18*b* (not shown). Covers 11, 12 consist of main cover sections 11*a*, 12*a* and narrow spine sections 11*b*, 12*b*. Longitudinal fold strip areas 11*c*, 12*c* hingedly connect main cover sections 11*a*, 12*a* with narrow spine cover sections 11*b*, 12*b*. Fold strip areas 11*c*, 12*c* have sufficient width to accommodate the thickness (t) of hook members 20, 21 (FIG. 4).

Figure 1:
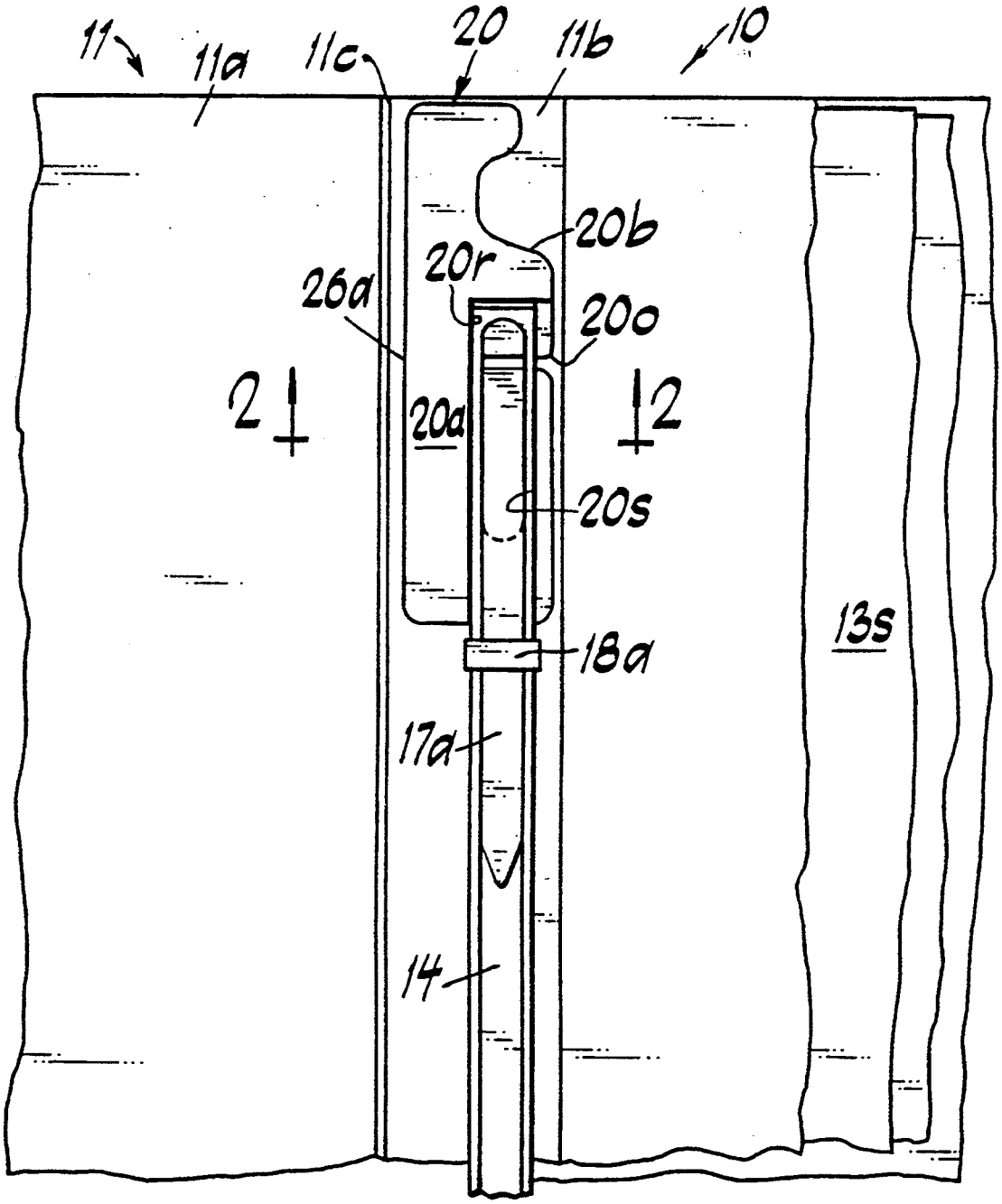
FIG. 1 is a partial plan view of the binder with front cover open showing the post binder and the upper hook in retracted position.
Figure 2:
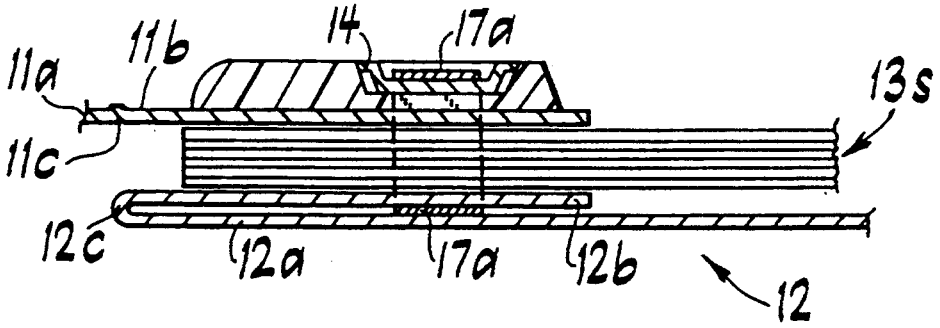
FIG. 2 is a sectional view taken along line 2—2 of FIG. 1.
Figure 3:
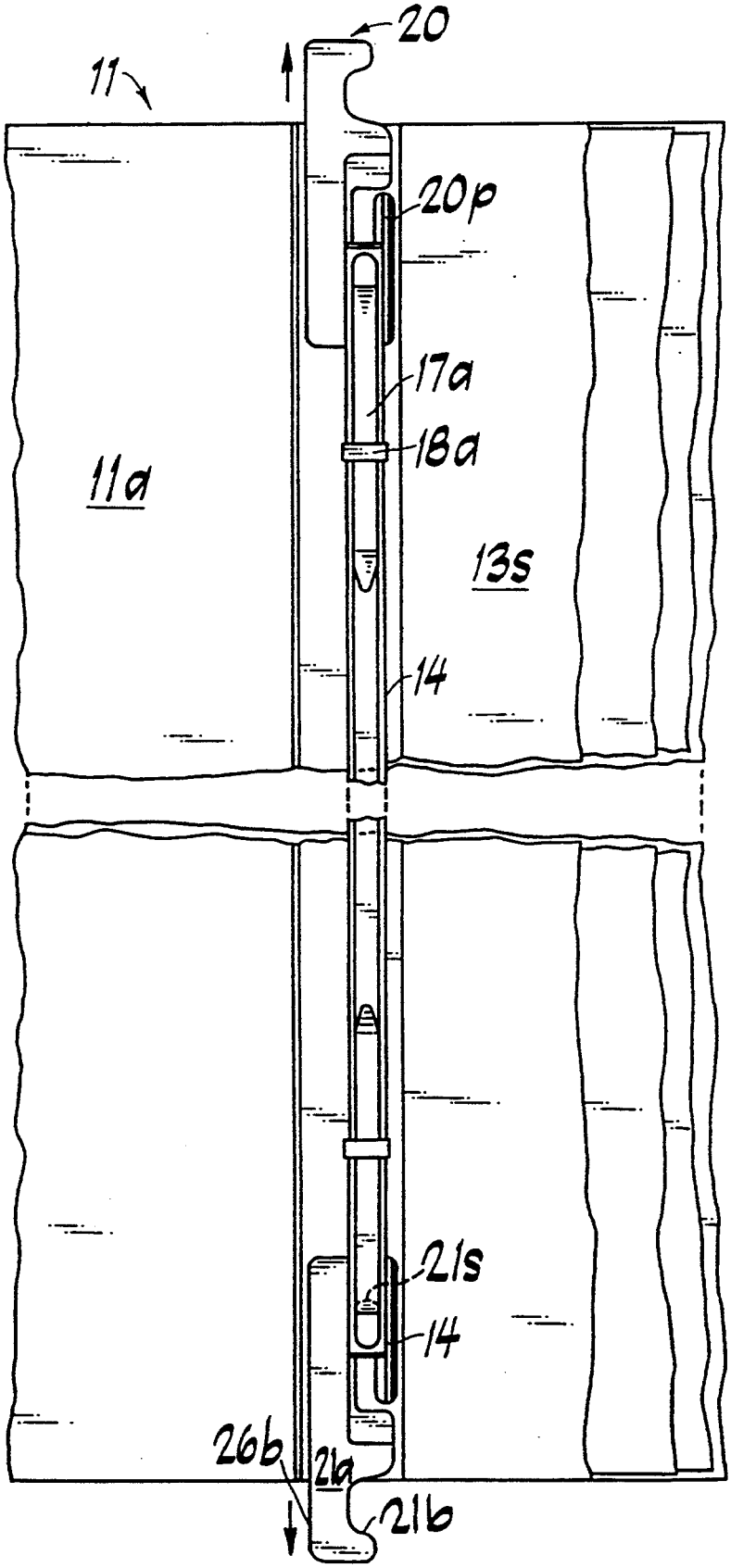
FIG. 3 is a partial plan view of the binder with front cover open and upper and lower hooks extended.
Figure 6:
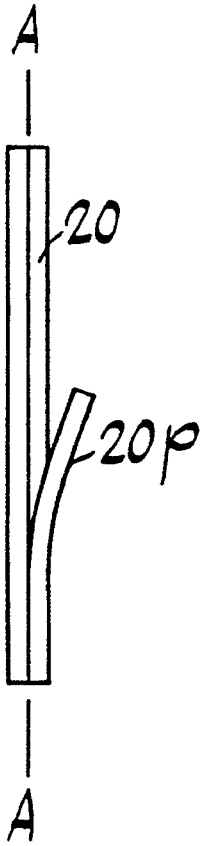
FIG. 6 is a side elevational view of a hook showing a portion deflected out of the plane of the body of the hook.

Hook members 20, 21 include body portions 20*a*, 21*a*, hook portions 20*b*, 21*b*, recessed body portions 20*r*, 21*r* which are thinner than thickness (+) t, longitudinal through-slots 20*s*, 21*s* and cross slot side openings 20*o*, 21*o*. Hook members 20,21 also have slot projecting portions 20*p*, 21*p* of the body portions 20*a*, 21*b* which border slots 20*s*, 21*s* and may be deflectable both in the plane A—A of the body portions 20*b*,21*b* of hook members 20,21 (FIG. 6) and perpendicular to the plane A—A which second deflection is shown in FIG. 6. Such deflections function to increase the effective size of cross slot opening 20*o*, 21*o* to permit the post 17*a*, 17*b* to pass in and out of slots 20*s*, 21*s*. Slot projection portions 20*p*,21*p* have (t) thicknesses. Hook member 20 is capable of being mounted on post 17*a* between rail 14 and front cover narrow spine section 11*b* by deflecting projection portion 20*p* as required. Hook recess 20*r* accommodates end portions of rail 14 (FIGS. 1 and 2). Post hold-down ring 18*a* is also shown in FIGS. 1 and 3.

Hook members 20,21 may alternately be engaged on posts 17*a*, 17*b* between back cover section 12*a* and spine cover section 12*b* or with heavy binders four (4) hooks could be used.

Figure 5:
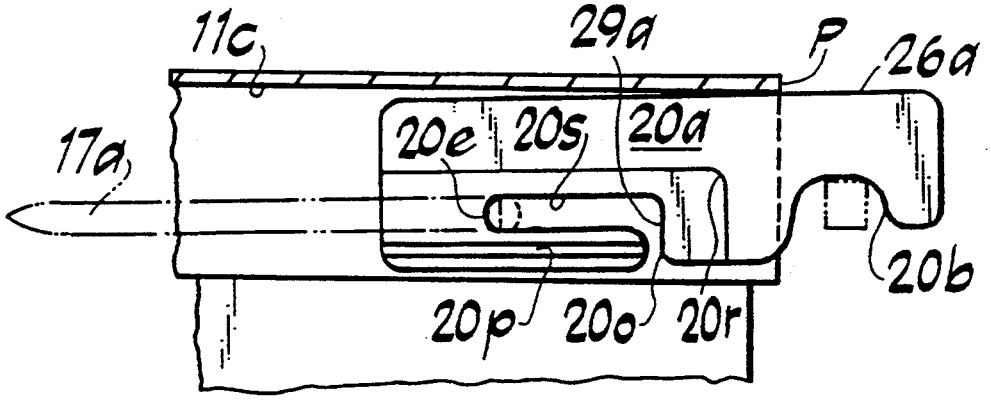
FIG. 5 is partial plan view showing a hook tilted when in its hanging position and also showing an alternative embodiment in which the posts are round in cross section.

In operation, hook members 20, 21 are installed on their respective posts 17*a*, 17*b* with or without undoing posts 17*a*, 17*b* from engagement with rail 14. To hang binder 10 on rack 22 having horizontal rack support bars 23, 24, hook members 20, 21 are pulled to their extended positions with longitudinal slot 20*s*, 21*s* allowing hook members to be extended until posts 17*a*, 17*b* abuts slot ends 20*e*, 21*e*. When front cover 11 is closed and binder 10 is hung on rack 22, the weight of the binder causes upper edges 26*a*, 26*b* of hook members 20, 21 to engage fold strip areas 11*a*, 12*a* at points P (FIG. 5) along fold areas 11*c*, 12*c* allowing hook members 20, 21 to rotate very slightly about posts 17*a*, 17*b*.

When binder 10 is removed from the rack, hooks 20, 21 may be retracted until posts 17*a*, 17*b* engage slot stop faces 29*a*, 29*b*.

I claim:

1. In a pair of detachable hook members for detachable engagement with the posts of a post and rail binder which hook members have longitudinal slots for receiving posts therein for extending and retracting such hook members, the improvement comprising a cross slot in each hook which communicates with the longitudinal slot and projection portion adjacent such longitudinal and cross slots, each cross slot approximately the width of the post to be received in the longitudinal slot.

2. The hook members of claim 1 in which each cross slot has a width less than the width of a post and in which the projection portion is deflectable to permit the post to pass along the cross slot.

3. The hook members of claim 1 in which each hook member has a recess portion to accommodate the rail.

4. A post and rail binder having a post, a rail, fold strip area means and a hook member mounted on the post and slidable in contact with the fold strip area means which hook member in turn comprises a) a longitudinal slot to accommodate the post;

b) a cross slot approximately equal in width to the width of the post which cross slot communicates with the longitudinal slot; and c) a projection portion adjacent such longitudinal and cross slots.

* * * * *